US005253383A

United States Patent [19]

Clark

[11] Patent Number: 5,253,383

[45] Date of Patent: Oct. 19, 1993

[54] SCRATCH SURFACE REMOVER

[76] Inventor: Rodney D. Clark, 212 Second Ave. E., Egan, S. Dak. 57024-9701

[21] Appl. No.: 864,936

[22] Filed: Apr. 7, 1992

[51] Int. Cl.[5] ..... A46B 13/02

[52] U.S. Cl. ..... 15/88.3; 15/34; 15/40; 15/77

[58] Field of Search ..... 15/21.1, 36, 34, 38, 15/39, 40, 77, 88.2, 88.3, 102, 100, 3.1

[56] References Cited

U.S. PATENT DOCUMENTS

| | | | |
|---|---|---|---|
| 235,328 | 12/1880 | Zimmerman et al. | 15/77 |
| 325,916 | 9/1885 | Daniels, Jr. | 15/77 |
| 2,799,877 | 7/1957 | Scott | 15/3.1 |
| 3,117,333 | 1/1964 | Murray et al. | 15/77 |
| 3,225,377 | 12/1965 | Winter et al. | 15/38 |
| 4,765,842 | 8/1988 | Sanders et al. | 15/88.3 |

*Primary Examiner*—Edward L. Roberts

[57] ABSTRACT

A mechanical device for scraping cover material from underlying information on cards such as lottery tickets. The device uses a power driven wire brush and includes a collector for the material scraped from the cards.

2 Claims, 2 Drawing Sheets

SCRATCH SURFACE REMOVER

BACKGROUND AND SUMMARY OF THE INVENTION

This invention pertains to brushing devices and more particularly to a device using a brush to clean covering material from the prize information on certain types of lottery cards.

Many lottery cards and also some advertising material use information covered by a soft plastic material to inform prize winners of the award. The instructions ordinarily suggest use of a coin or the like to scrape off the plastic material to determine the underlying information. That system works in most instances.

The old system, however, has certain disadvantages—particularly for the outlets in which lottery tickets are sold. It is relatively slow requiring considerable scraping before the underlying information can be completely seen. It also results in considerable waste scrapings which can be very undesirable in some stores.

By my invention I provide a power operated device which will quickly remove the covering material and will deposit the scrapings in a receptacle designed to receive them. The container can be removed for emptying as needed.

DESCRIPTION

Figure 1:
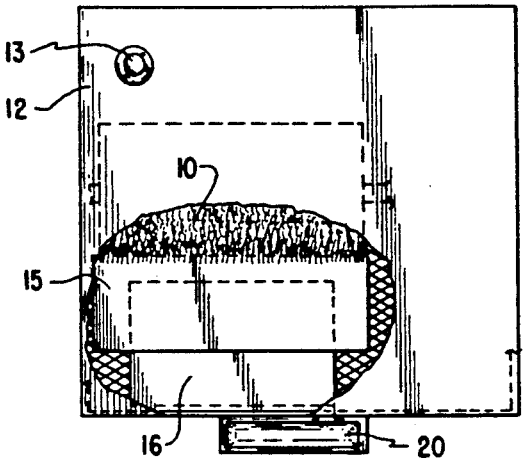
FIG. 1 is a top plan view of the brush device with part broken away to show the underlying parts.
Figure 3:
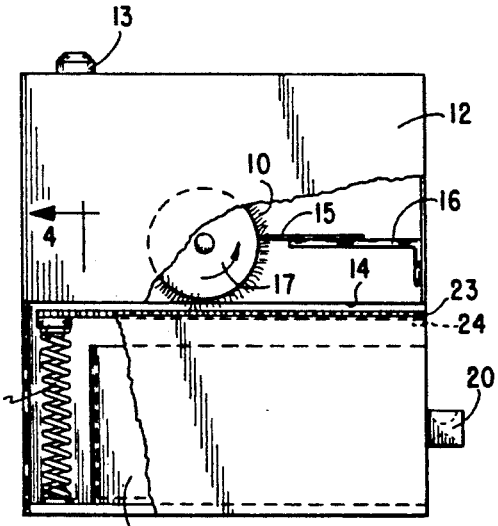
FIG. 3 is a side elevational view of the device with parts broken away to show underlying parts.
Figure 2:
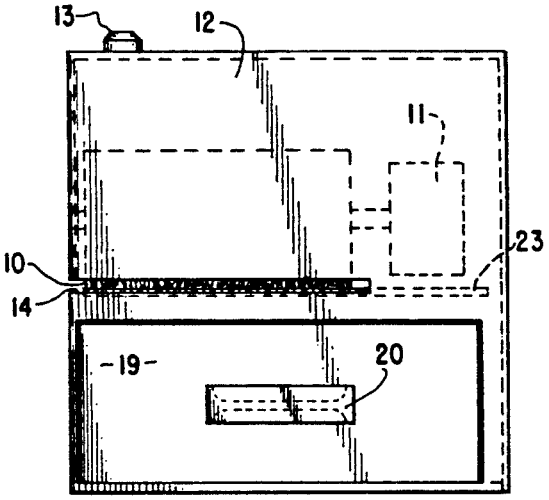
FIG. 2 is a front elevational view of the device.
Figure 4:
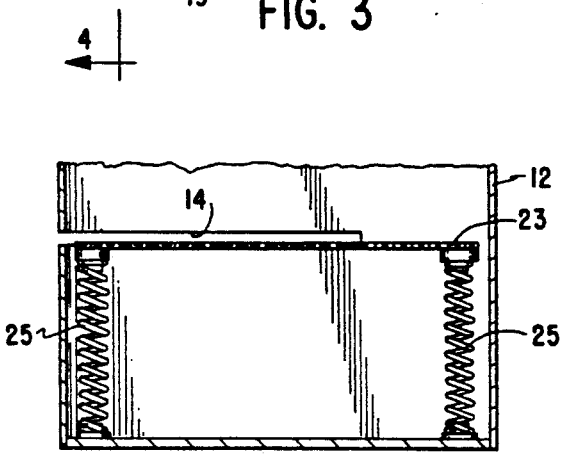
FIG. 4 is a sectional view from line 4—4 of FIG. 3.

Briefly my invention comprises an enclosed device having a powered brush for scraping cover material from lottery cards, a cleaning means adapted to remove the material from the brush and a removable receiver to receive the scrapings and to allow the material to be deposited in a waste disposal device.

More specifically and referring to the drawings, the surface remover consists principally of a rotary brush 10 driven by a motor 11 and contained within a housing 12. The brush may be formed with a thin, relatively flexible wire surface mounted on a drum. It is journalled in the housing and may be directly driven by the motor 11.

The motor 11 may be powered either from ordinary lighting current or may use batteries as a source of power. In the latter case, the housing 12 will necessarily accommodate those batteries by means well understood in the art. In either case, control of the flow of power is made possible by use of a push-button switch 13 mounted on the housing 12. It will be apparent that any of several types of contact switches might also be used to control the motor. Such a switch can be mounted for contact by the card as it is inserted into the machine as will later appear.

The housing 12 is formed generally in two compartments separated by a card slot 14 extending from the front to the back of the housing and laterally from one side across approximately one-half of the width of the housing. This slot 14 and the axial length of the brush 10 should be approximately equal so that the brush will sweep over the full width of that part of the card inserted into the Blot 14.

In order to avoid clogging of the brush with scrapings, a brush scraper or comb 15 as supported from the front wall of the housing by a bracket 16. The comb 15 is positioned to engage the surface of the brush 10. Thus as the brush rotates in the direction indicated by the arrow 17, it will first engage the surface of a card in the slot 14 and then rotate against the comb 15. The comb which may have a serrated edge, or may be simply a scraper with a flat edge will serve to knock the scrapings from the bristles of the brush.

A drawer 19 located in the housing 12 beneath the brush 10 is open to catch the scrapings as they fall from the brush. This drawer 19 includes a handle 20 and can easily be removed from the housing 12 for emptying.

To support the card as it is being brushed, a card support floor 23 is located within the housing 12 below the slot 14. This floor is preferably made from a meshed material having a large enough mesh to allow fragments of the plastic which will be brushed from the card to fall through the mesh and into the drawer 19. At the front of the housing, the floor 23 is supported from a ledge 24 on which the floor 23 rests. At the rear of the housing, two compression springs 25 at the rear corners of the floor urge the floor 23 into contact with the brush 10 at a near-constant pressure. Thus, the device can readily accommodate cards of somewhat different thicknesses without any adjustment or reconstruction being required. This feature is also effective to provide near constant pressure on the brush regardless of some amount of wear on the brush 30.

The operation of the device is quite apparent from the description. A card having a bit of covered printed matter may be inserted into the slot 14 and be slid from front to back across the floor 23. The springs 25 will hold the card against the brush 10. Rotation of the brush 10 is started either by pressing the push button 13 to actuate a switch controlling the motor 11 or by the insertion of the card actuating an automatic switch of a type well known in the art.

As the brush 10 rotates it will scrape the plastic material from the card exposing the printed material which can then be read. Meanwhile, the plastic material is cleaned from the brush 10 by the comb 15 causing the material to fall through the meshed floor 23 and into the drawer 19 from which it can be emptied as the drawer fills.

Figure 5:
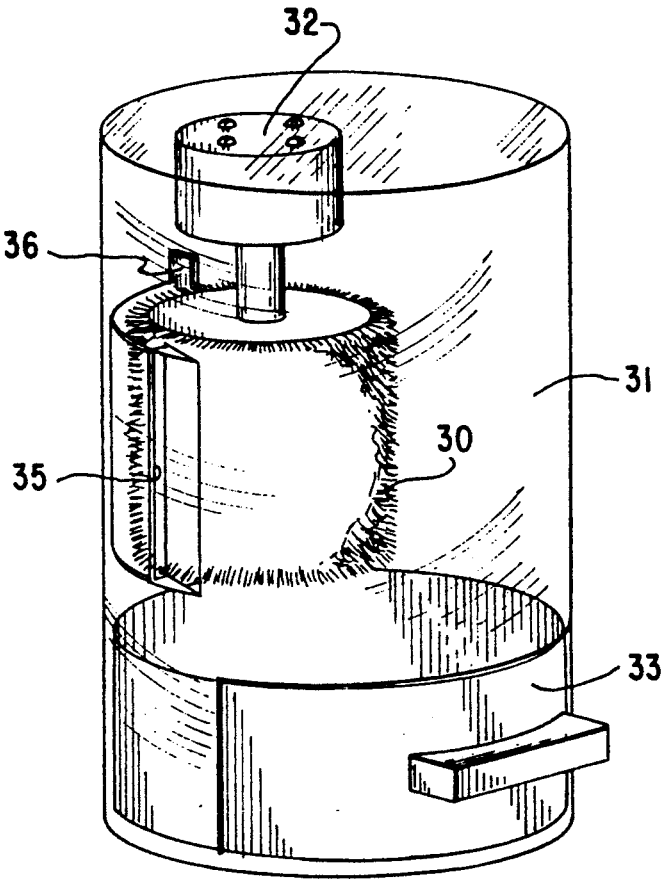
FIG. 5 is a perspective view in phantom illustrating an alternative embodiment of the invention.

It will be recognized that a horizontal slot is not the only direction in which the Blot may lie. A possible alternate is illustrated in FIG. 5. In this embodiment, the brush 30 is located within a cylindrical housing 31. This housing 31, as illustrated in FIG. 5, may be made from a transparent plastic material so that users can watch as the material is brushed from their card. The motor 32 is mounted from the top of the housing so that there is a clear opening into the drawer 33. Thus shavings can fall directly into the drawer. A vertical card slot 35 is provided in the side of the housing so that a card can be inserted on a curved path. Because of the resistance of the card to bending, it will be held against the brush 30. A stop 36 prevents the card from being inserted too far and can also serve as a comb to clean the brush. In this embodiment, the same types of switches may be used as in the first described device.

I claim as my invention:

1. A device for brushing a plastic surface from a lottery card or the like comprising a housing, a rotary brush mounted in said housing motive means operably connected to said brush to drive the brush, said housing formed with a slot to receive said card, floor means movably mounted in said housing below said slot on which said card is slidably moved beneath said brush, and spring means beneath said floor means adapted to press said card against said brush.

2. The brushing device of claim 1 in which said floor means is formed of a floor with an open mesh, drawer means in said housing beneath said floor whereby plastic material brushed from said card will fall through said open mesh into said drawer.

* * * * *